US005448980A

United States Patent [19]

Kawamura et al.

[11] Patent Number: 5,448,980

[45] Date of Patent: Sep. 12, 1995

[54] LEAK DIAGNOSIS SYSTEM FOR EVAPORATIVE EMISSION CONTROL SYSTEM

[75] Inventors: Katsuhiko Kawamura, Yokohama; Masato Kobayashi, Atsugi, both of Japan

[73] Assignee: Nissan Motor Co., Ltd., Yokohama, Japan

[21] Appl. No.: 168,312

[22] Filed: Dec. 17, 1993

[30] Foreign Application Priority Data

Dec. 17, 1992 [JP] Japan ..... 4-337306

[51] Int. Cl.[6] ..... F02M 33/04; F02B 77/00

[52] U.S. Cl. ..... 123/520; 123/198 D

[58] Field of Search ..... 123/516, 518, 520, 198 D, 123/519

[56] References Cited

U.S. PATENT DOCUMENTS 5,158,054 10/1992 Otsuka ..... 123/520
5,191,870 3/1993 Cook ..... 123/198 D
5,193,512 3/1993 Steinbrenner et al. ..... 123/198 D
5,261,379 11/1993 Lipinski et al. ..... 123/520
5,275,144 1/1994 Gross ..... 123/520
5,295,472 3/1994 Otsuka et al. ..... 123/198 D
5,297,529 3/1994 Cook et al. ..... 123/198 D

OTHER PUBLICATIONS

California Air Resources Board (Carb) Techenical Support Document—(OBD II) Released Jul. 26, 1991 pp. ii-1, 12-15.

*Primary Examiner*—Thomas N. Moulis
*Attorney, Agent, or Firm*—Low, Price, Leblanc & Becker

[57] ABSTRACT

A leak diagnosis system is provided for diagnosing a leak condition of an evaporative emission control system for an internal combustion engine. The leak diagnosis system receives a signal indicative of a pressure in the evaporative emission system and obtains a converged limit negative pressure in the evaporative emission control system when the evaporative emission control system is communicated with the operating engine. The leak diagnosis system diagnoses a leak condition by comparing the converged limit negative pressure with a leak decision value.

8 Claims, 20 Drawing Sheets

LEAK DIAGNOSIS SYSTEM FOR EVAPORATIVE EMISSION CONTROL SYSTEM

BACKGROUND OF THE INVENTION

1. Field of the Invention

The present invention relates to a leak diagnosis system for an evaporative emission control system applied to an internal combustion engine.

2. Description of the Prior Art

A variety of evaporative emission control systems for automotive vehicles have been proposed and practically used. A typical evaporative emission control system is provided with a charcoal canister for preventing evaporative fuel in a fuel tank from being purged into the atmosphere. In this evaporative emission control system the charcoal canister adsorbs evaporative fuel from the fuel tank and discharges it into the engine by utilizing the negative pressure generated by an internal combustion engine.

However, such an emission control system has a possibility that evaporative fuel is leaked into the atmosphere if a leakage hole is generated at an evaporative fuel conduit or if an unsealed portion is generated at a connecting portion of the evaporative fuel conduit. If such a defect is generated in the evaporative emission control system, it is impossible to effectively operate the evaporative emission control system. In order to prevent such troubles, EPA (Environmental Protection Agency) and CARB (California Air Resources Board) have proposed a leakage diagnosis system and a practical method thereof. Such a leak diagnosis system is shown in FIG. 24 and a flowchart for controlling the diagnosis system is shown in FIG. 25. As shown in FIG. 24, an end of an evaporative fuel conduit 102*a* is connected to a fuel tank 101, and the other end of the evaporative fuel conduit 102*a* is connected to a charcoal canister 103 adsorbing evaporative fuel. A pressure sensor 106 is disposed in the way of the evaporative fuel conduit 102*a* in order to detect a pressure in the evaporative fuel conduit 102*a*. The signal from the pressure sensor 106 is inputted into an engine control unit 150 such that a changing speed of the pressure in the evaporative fuel conduit 102*a* is obtained. The engine control unit 150 has previously stored a decision value for diagnosing a leakage of evaporative fuel and implements the diagnosis by comparing the pressure changing speed with the decision value. An end of an evaporative fuel conduit 102*b* is connected to the charcoal canister 103, and the other end of the evaporative fuel conduit 102*b* is connected to an intake side of the internal combustion engine. A purge-cut valve 104 is disposed in the way of the evaporative fuel conduit 102*b*. The evaporative fuel adsorbed in the charcoal canister 103 is purged into the internal combustion engine during an engine operating condition upon opening the purge-cut valve 104. A drain-cut valve 105 is connected to a bottom of the charcoal canister 103 so as to cut the communication between the charcoal canister 103 and the atmosphere during the leak diagnosis.

Such a conventional leak diagnosis system implements the leak diagnosis according to the flow chart of FIG. 25 as follows.

In a step S10 the purge-cut valve 104 is opened during a predetermined engine operating condition, so that the evaporative fuel adsorbed in the charcoal canister 103 is purged into the engine due to intake negative pressure generated by the engine.

In a step S20 the drain-cut valve 105 is closed such that the negative pressure of the engine is applied to the evaporative emission control system which includes the fuel tank 101 and the evaporative fuel conduits 102*a* and 102*b*.

In a step S30 it is judged whether the pressure in the evaporative emission control system has reached a predetermined pressure value or not. Otherwise, in the step S30 it is judged whether a predetermined time has elapsed from the start of the sucking operation. When the judgment in the step S30 is "NO", the program returns to the step S20. When the judgment in the step S30 is "YES", the program proceeds to a step S40.

In the step S40 the purge-cut valve 4 is closed.

In a step S50 the engine control unit 150 monitors the change of the pressure in the inner space on the basis of the signal of the pressure sensor 106 and detects the pressure changing speed or pressure buildup speed toward the atmospheric pressure.

In a step S60 it is judged whether the detected pressure changing speed toward the atmospheric pressure is larger than the decision value or not. When the judgment in the step S60 is "YES", the program proceeds to a step S70 wherein it is judged that the system is in a leak condition. When the judgment in the step S60 is "NO", the program proceeds to a step S80 wherein it is judged that the system is in a no-leak condition.

Following the operation of the step S70 or S80, the program proceeds to a step S90 wherein the drain-cut valve 105 is opened.

However, since the above-mentioned leak diagnosis system is arranged to implement the leak diagnosis by obtaining the pressure changing speed toward the atmospheric pressure, after the pressure in the evaporative emission control system reaches a predetermined pressure by closing the drain-cut valve 105 and the purge-cut valve 104 is then closed. Accordingly, the conventional leak diagnosis system has some problems, such that it takes a long time for the implement of the leak diagnosis, and the conventional leak diagnosis system is complicated due to its complicated control algorithm. Furthermore, the pressure changing speed takes various values due to the fuel condition in the evaporative emission control system, such as a change of the inner space volume which changes according to the remaining amount of fuel in the fuel tank, or a change of the generating amount of fuel vapor which changes according to the fuel temperature, as shown in FIG. 20. Therefore, it is difficult to accurately diagnose the leak condition of the evaporative emission control system by using the conventional leak diagnosis system.

SUMMARY OF THE INVENTION

It is an object of the present invention to provide an improved leak diagnosis system which shortens a time period for diagnosing the leakage of evaporative fuel from an evaporative emission control system.

Another object of the present invention is to provide an improved leak diagnosis system which accurately diagnoses a leak condition while taking the effect of the fuel remaining amount and the fuel vapor pressure into consideration.

A leak diagnosis system according to the present invention is for an evaporative emission control system of an internal combustion engine. The leak diagnosis system comprises a pressure sensor which detects a pressure in the evaporative emission control system. A leak diagnosis unit obtains a converged limit negative pressure in the evaporative emission control system which is under a suction generated by the engine. The leak diagnosis unit diagnoses a leak condition of the evaporative emission control system by comparing the converged limit negative pressure with a predetermined leak decision value.

BRIEF DESCRIPTION OF THE DRAWINGS

In the drawings, like reference numerals designate like elements and parts all through the figures, in which.

DETAILED DESCRIPTION OF THE INVENTION

Referring to FIGS. 1 to 5, there is shown a first embodiment of a leak diagnosis system for an evaporative emission control system in an internal combustion engine for an automotive vehicle, in accordance with the present invention.

Figure 1:
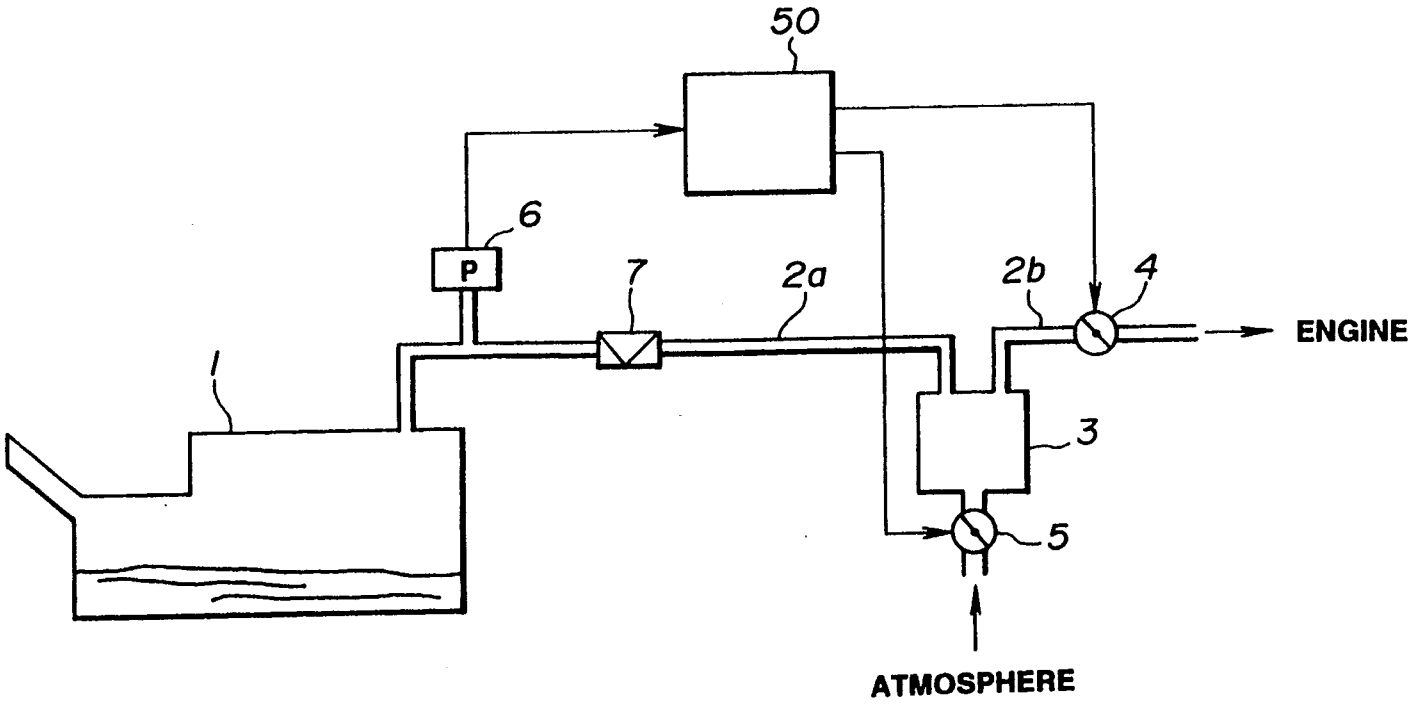
FIG. 1 is a block diagram which shows a construction of a first embodiment of a leak diagnosis system for an evaporative emission control system according to the present invention.

As shown in FIG. 1, in the evaporative emission control system, a first evaporative fuel conduit 2*a* connects an upper end portion of a fuel tank 1 and a charcoal canister 3 which temporally adsorbs and stores evaporative fuel from the fuel tank 1. A pressure sensor 6 functioning as a pressure detecting means is disposed in the first evaporative fuel conduit 2*a* and communicated with an engine control unit 50. A check valve 7 is disposed in the first evaporative fuel conduit 2*a* in order to effectively supply evaporative fuel to the charcoal canister 3 in such a manner that the check valve 7 is opened when a pressure difference between the fuel tank 1 and the charcoal canister 3 becomes larger than a predetermined value while preventing evaporative fuel from flowing from canister side to the fuel tank side. A second evaporative fuel conduit 2*b* connects the charcoal canister 3 and an intake side of the internal combustion engine. A purge-cut valve 4 is disposed in the way of the second evaporative fuel conduit 2*b* and is communicated with the engine control unit 50. The evaporative fuel, which is adsorbed in the charcoal canister 3, is purged into the internal combustion engine during an engine operating condition upon opening the purge-cut valve 4. A drain-cut valve 5 is connected to a bottom of the charcoal canister 3 in order to cut the communication between the charcoal canister 3 and the atmosphere during the leak diagnosis. The drain-cut valve 5 is communicated with the engine control unit 50 so as to be controlled by the engine control unit 50.

A signal outputted from the pressure sensor 6 is inputted in the engine control unit 50 in which the pressure in the evaporative emission control system is monitored so as to detect a condition of the negative pressure in the evaporative emission control system according to the signal from the pressure sensor 6 in which the pressure reaches or converges to a limit, referred to hereinafter as the "converged limit negative pressure". This is best understood with reference to FIG. 5 in which the graphical plot of the pressure in the evaporative control system is seen to drop to the converged limit negative pressure the value of which becomes steady as seen by the horizontal position of the plot. A leak decision value is stored in a memory of the engine control unit 50 in order to diagnose the leakage of the evaporative fuel from the evaporative emission control system.

Figure 3:
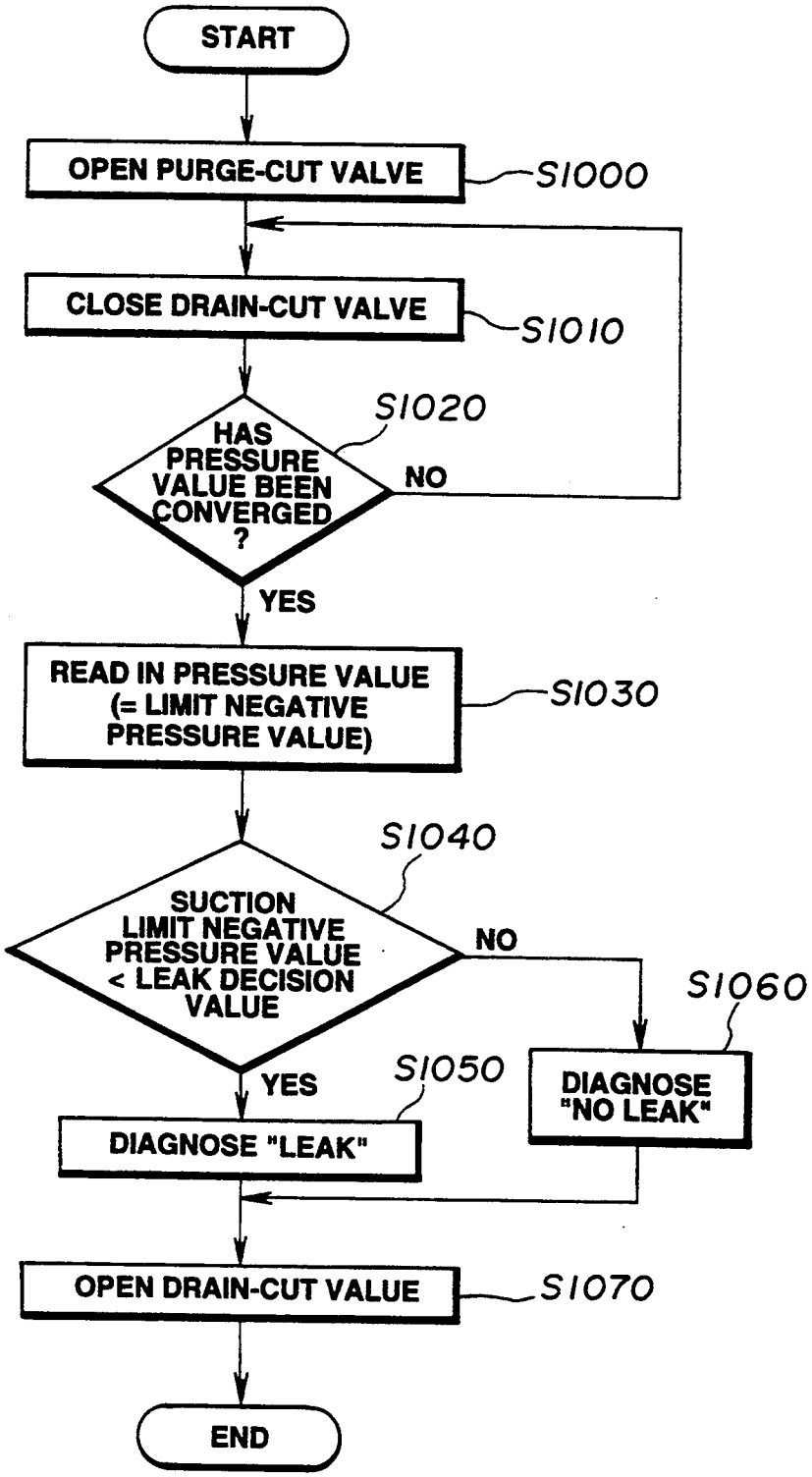
FIG. 3 is a flow chart applied to a control of the first embodiment of FIG. 1.
Figure 4:
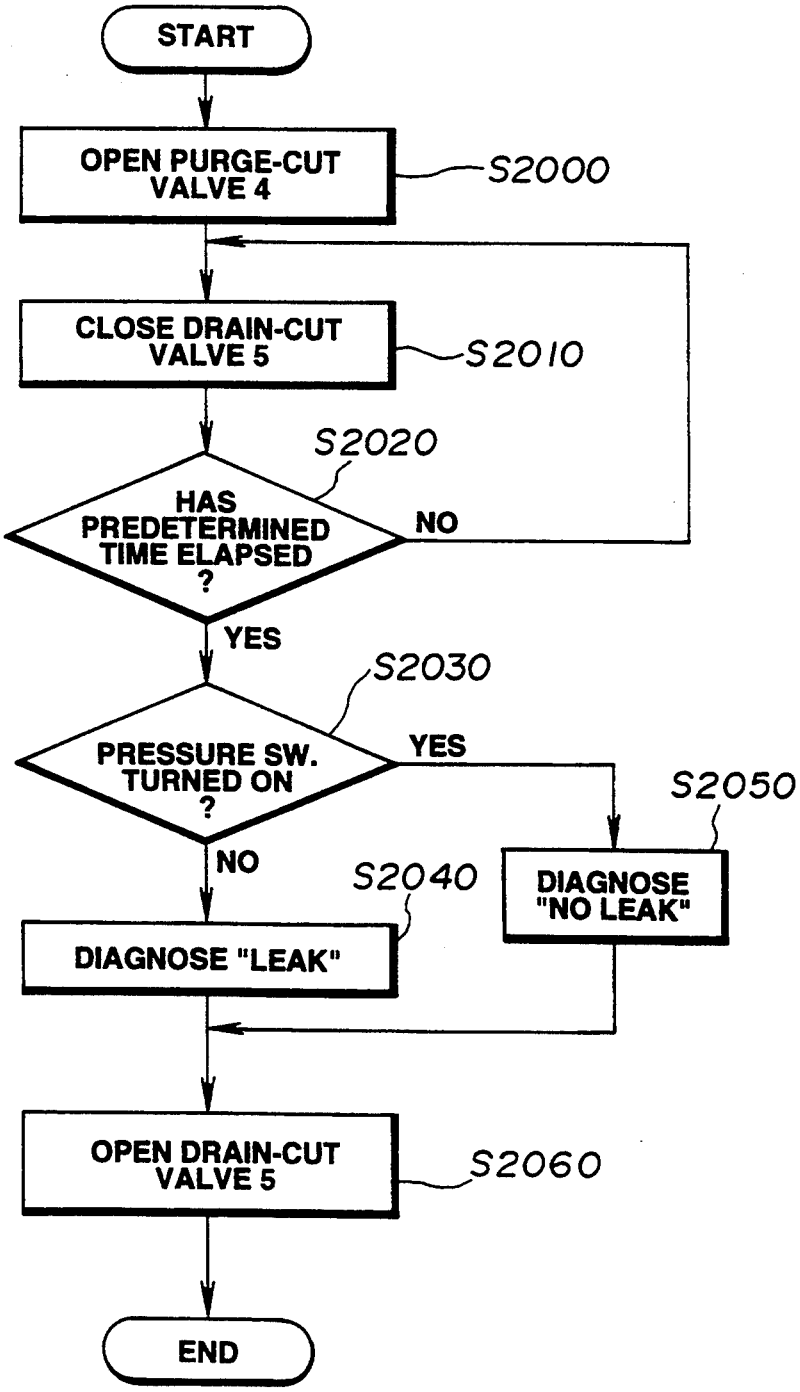
FIG. 4 is another flow chart to a control of the first embodiment which uses a pressure switch instead of a pressure sensor.

A diagnosis of the leakage from the evaporative emission control system is implemented by the engine control unit 50 according to a flow chart shown in FIG. 3.

In a step S1000 the purge-cut valve 4 is opened during a predetermined engine operating condition, so that the evaporative fuel adsorbed in the charcoal canister 3 is purged into the engine due to intake negative pressure generated in the engine.

In a step S1010 the drain-cut valve 5 is closed such that the negative pressure of the engine is applied to an evaporative emission control system constituted by the evaporative fuel conduits 2*a* and 2*b*, the charcoal canister 3 and the fuel tank 1.

In a step S1020 it is judged whether the negative pressure in the evaporative emission control system has converged or not. When it is judged that the negative pressure in the evaporative emission control system has converged, the program proceeds to a step S1030. When the negative pressure has not converged, the program returns to the step S1010.

In the step S1030 the converged limit negative pressure value is read in the engine control unit 50.

Figure 5:
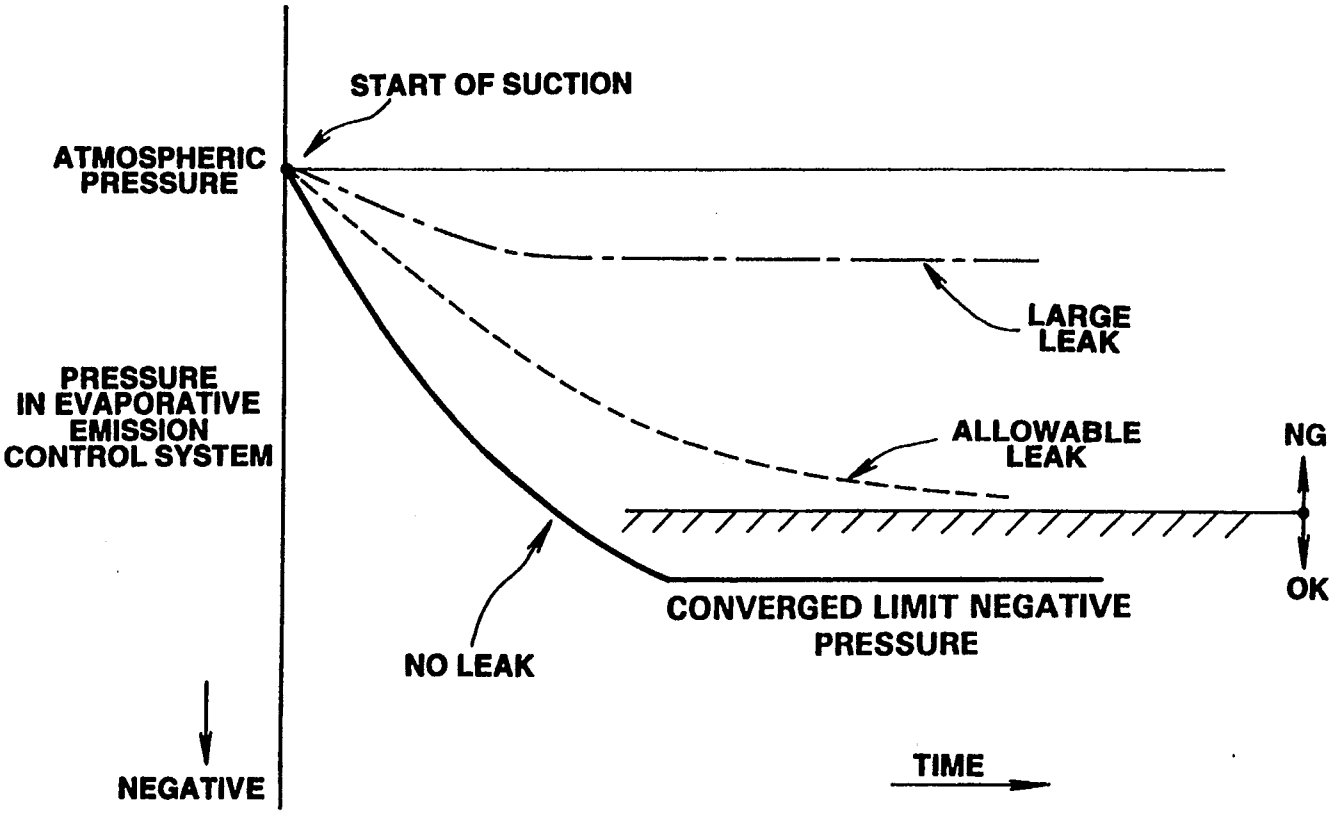
FIG. 5 is a graph in which a change of the pressure in the evaporative emission control system of the first embodiment is shown in a sucked condition.
Figure 6:
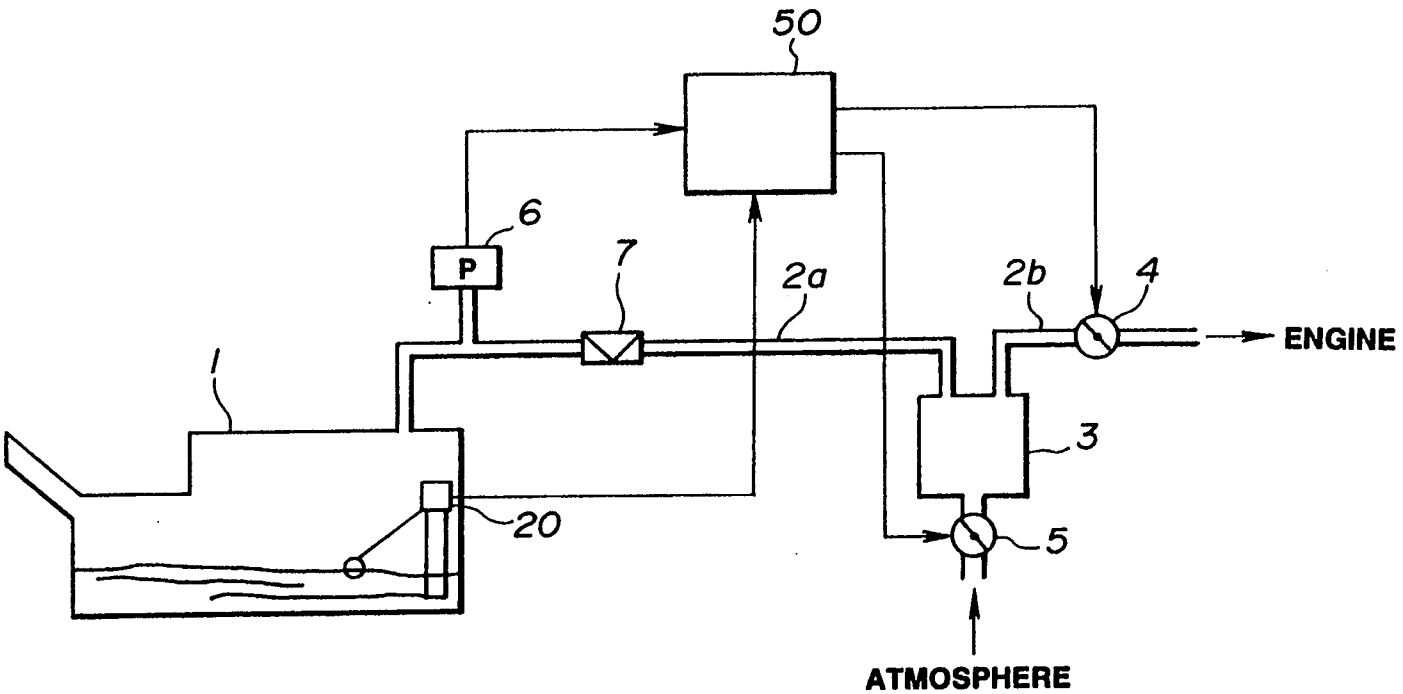
FIG. 6 is a block diagram which shows a construction of a second embodiment of the leak diagnosis system.

In a step S1040 the converged negative pressure value is compared with the leak decision value which is previously stored in the engine control unit 50. When the converged negative pressure value is smaller (nearer to the atmospheric pressure) than the leak decision value, the program proceeds to a step S1050 wherein it is judged that a leak amount from the evaporative emission control system is greater than an allowable value, that is, it is judged that the evaporative emission control system is in a leak condition. When the converged negative pressure value is larger (further from the atmospheric pressure) than or equal to the leak decision value, the program proceeds to a step S1060 wherein it is judged that the leak amount of evaporative fuel is smaller that or equal to the allowable value, that is, it is judged that the evaporative emission control system is in a no-leak condition. Such changes of the pressure in the system are shown in FIG. 5. In the program, the steps S1040, S1050 and S1060 function an evaporative fuel leak diagnosis means.

In a step S1070 the drain-cut valve 5 is opened, and the program then terminates.

With this arrangement of the leak diagnosis system, the converged limit negative pressure value in the evaporative emission control system during a suction by the engine is detected and is compared with the leak decision value. Accordingly, it becomes possible to easily and quickly implement the leak diagnosis.

Figure 2:
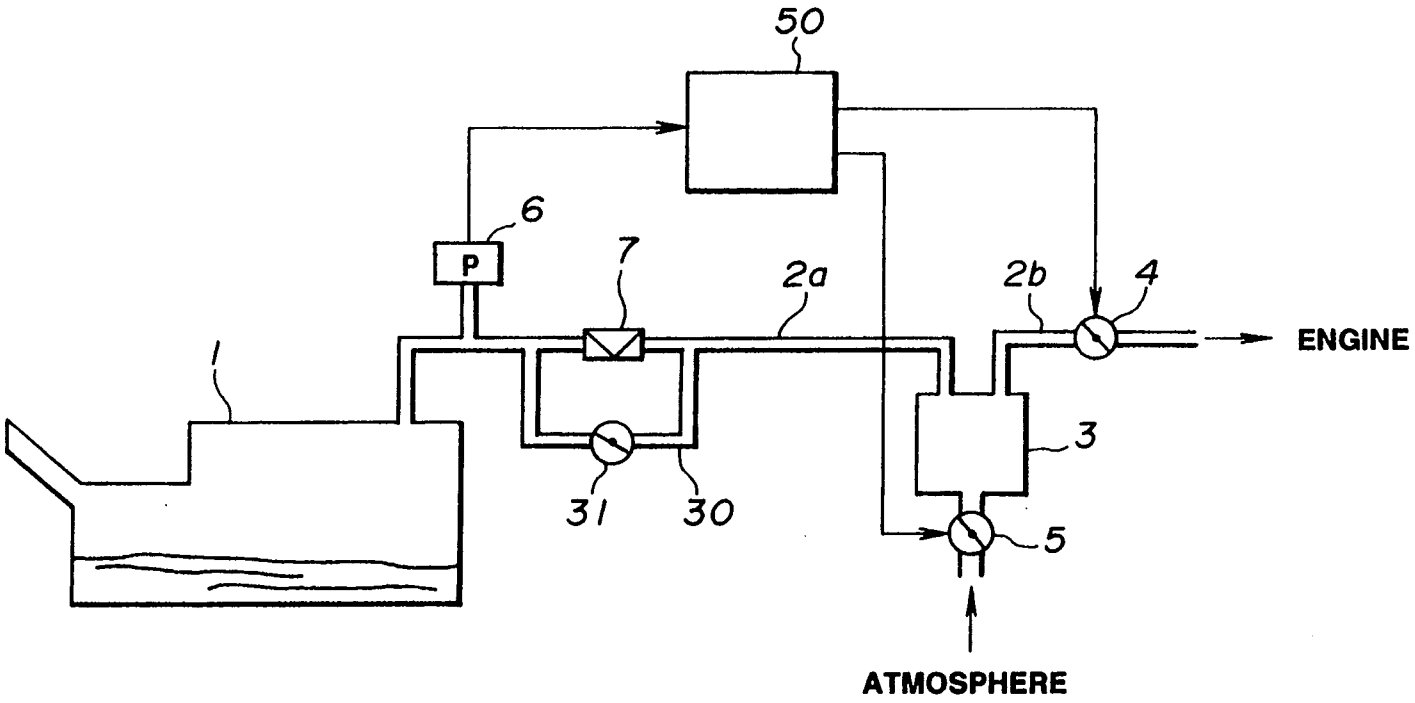
FIG. 2 is another block diagram which shows a slightly modified embodiment of FIG. 1.

In addition, if a bypass passage 30 for bypassing the check valve 7 and a bypass valve 31 formed in the way of the bypass passage 30 are installed in the first embodiment as shown in FIG. 2, the effect of the opening pressure of the check valve 7 is canceled by opening the bypass valve 31 at the step S1010. Accordingly, a high accuracy in a leak diagnosis is obtained by canceling the change of the error generated by a position of a leakage.

Furthermore, it will be understood that a pressure switch, which outputs an ON signal to the engine control unit 50 when the pressure in the system is higher (further from the atmospheric pressure) than a predetermined value, may be used as a detecting means for detecting the converged negative pressure value. When the pressure switch is applied to the first embodiment of the leak diagnosis system instead of the pressure sensor 6, a diagnosis of the leakage of the evaporative emission control system is implemented by the engine control unit 50 according to a flow chart shown in FIG. 4.

In a step S2000 the purge-cut valve 4 is opened during a predetermined engine operating condition, so that the evaporative fuel adsorbed in the charcoal canister 3 is purged into the engine due to intake negative pressure generated in the engine.

In a step S2010 the drain-cut valve 5 is closed such that the negative pressure of the engine is applied to an evaporative emission control system constituted by the evaporative fuel conduits 2*a* and 2*b*, the charcoal canister 3 and the fuel tank 1.

In a step S2020 it is judged whether a predetermined time has elapsed from the start of this program or not. When the judgment in the step S2020 is "NO", the program returns to the step S2010. When the judgment in the step S2020 is "YES", the program proceeds to a step S2030.

In a step S2030 it is judged whether the pressure switch is turned on and outputs an ON signal to the engine control unit 50 or not. When the ON signal is inputted in the engine control unit 50, the program proceeds to a step S2050 wherein it is judged that the leak amount of evaporative fuel is smaller that or equal to the allowable value. When the ON signal is not inputted to the engine control unit 50, the program proceeds to a step S2040 wherein it is judged that a leak amount from the evaporative emission control system is greater than an allowable value.

In the program, the steps S2030, S2040 and S2050 function as an evaporative fuel leak diagnosis means.

Following the operation of the step S2040 or S2050, the program proceeds to a step S2060 wherein the drain-cut valve 5 is opened. Then, the program proceeds to "END".

Referring to FIGS. 6 to 9, there is shown a second embodiment of the leak diagnosis system according to the present invention.

The construction of the second embodiment is generally similar to that of the first embodiment except that a fuel remaining amount detector 20 is installed in the fuel tank 1. The fuel remaining amount detector 20 detects a fuel amount in the fuel tank 1 and outputs a signal indicative of the fuel remaining amount to the engine control unit 50. The fuel remaining amount detector 20 functions as an inner space volume detecting means. The pressure sensor 6 is installed to the first evaporative fuel conduit 2*a* and is arranged to obtain the limit negative pressure value in the inner space of the evaporative emission control system, as is similar to the first embodiment.

Figure 8:
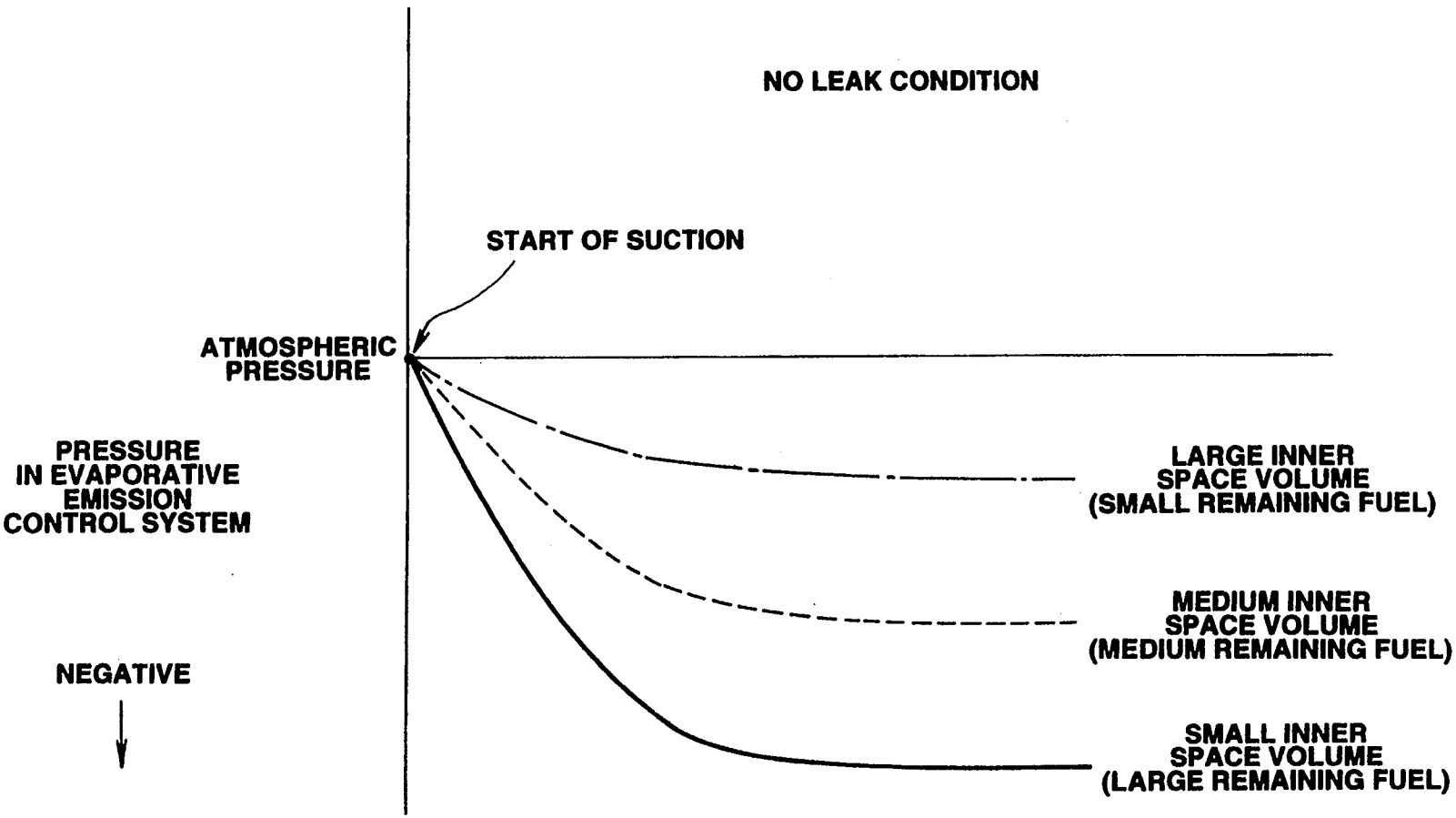
FIG. 8 is a graph in which a change of the pressure in the evaporative emission control system of the second embodiment relative to the remaining fuel amount is shown in a sucked condition.
Figure 9:
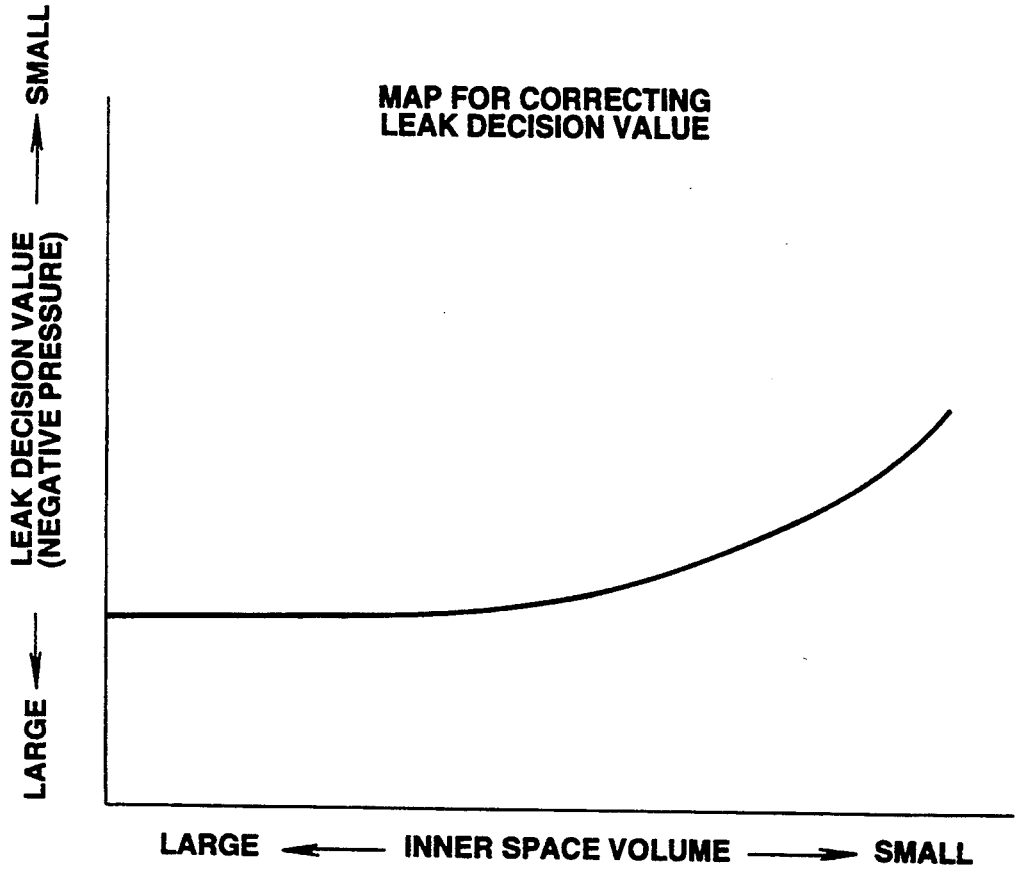
FIG. 9 is a map used in the second embodiment for a correction of a decision value of the leakage in the evaporative emission control system.
Figure 10:
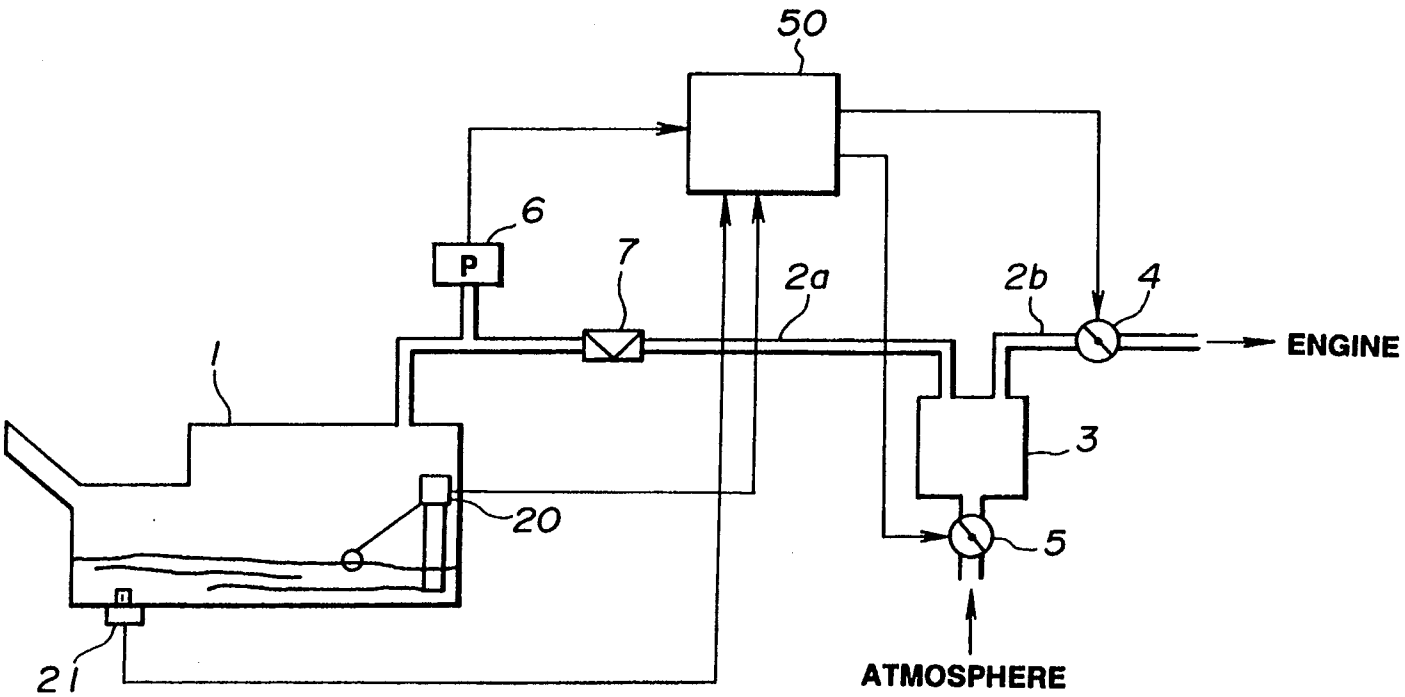
FIG. 10 is a block diagram which shows a construction of a third embodiment of the leak diagnosis system according to the present invention.

As shown in FIG. 8, even if the evaporative emission system is in a no-leak condition, the limit converged negative pressure becomes different due to the inner space volume of the evaporative emission control system. That is, when the inner space volume is small, the limit converged negative pressure reaches a high negative pressure value as shown by a continuous line in FIG. 8. On the other hand, when the inner space volume is large, the limit converged negative pressure reaches a low negative pressure value as shown by a long and short dash line in FIG. 8. Taking this result into consideration, the engine control unit 50 previously stores a map which is used for selecting a leak decision value according to the inner space volume in the evaporative emission control system as shown in FIG. 9.

Figure 7:
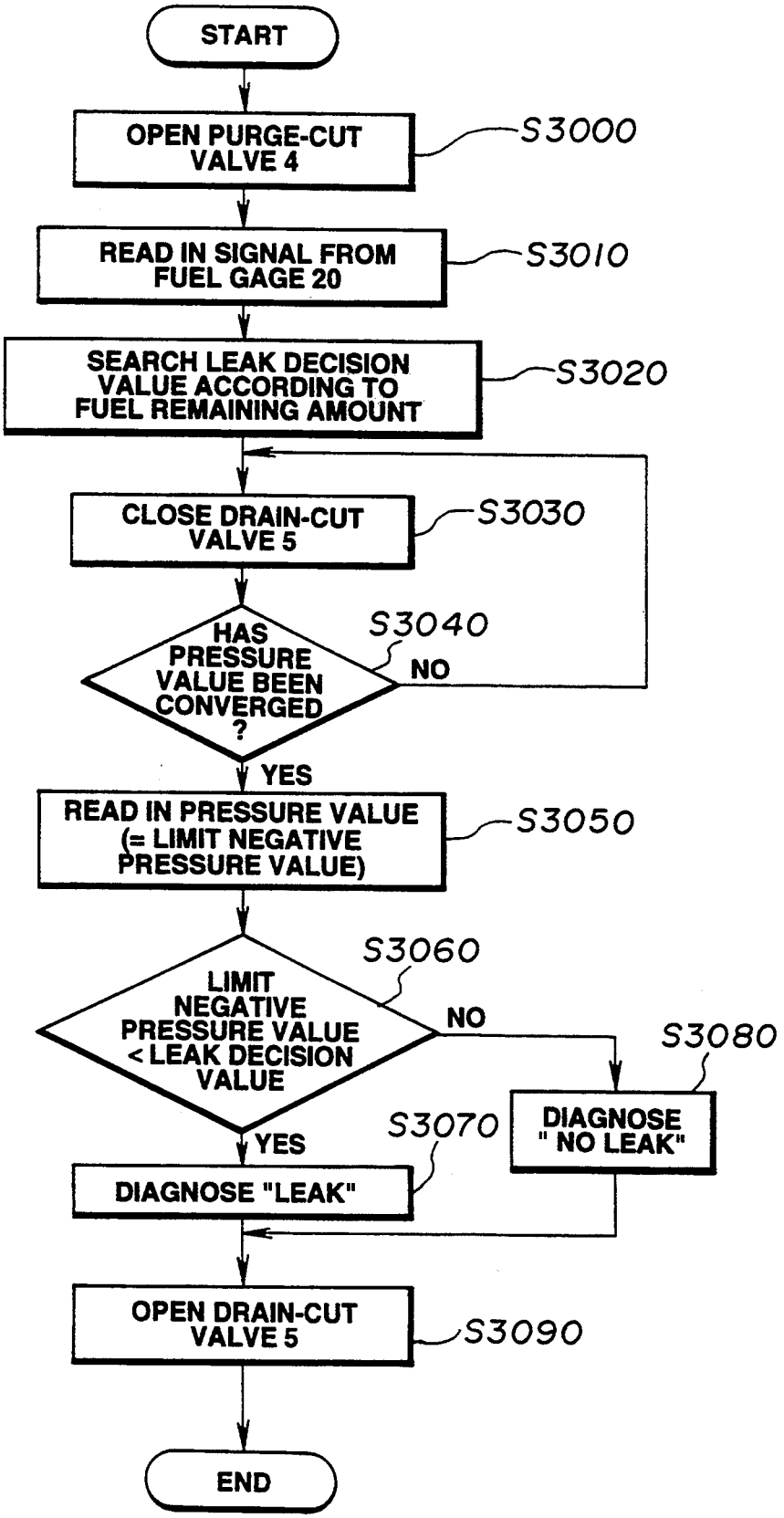
FIG. 7 is a flow chart applied to a control of the first embodiment of FIG. 6.

The manner of operation of the leak diagnosis operation by the engine control unit 50 will be discussed hereinafter with reference to a flow chart of FIG. 7.

In a step S3000 the purge-cut valve 4 is opened during a predetermined engine operating condition, so that the evaporative fuel adsorbed in the charcoal canister 3 is purged into the engine due to intake negative pressure generated in the engine.

In a step S3010 the engine control unit 50 reads in the signal from the fuel remaining amount detector 20 in order to detect the fuel remaining amount in the fuel tank 1.

In a step S3020 the leak decision value is selected from the map of FIG. 9 according to the fuel remaining amount.

In a step S3030 the drain-cut valve 5 is closed such that the negative pressure of the engine is applied to an evaporative emission control system constituted by the evaporative fuel conduits 2a and 2b, the charcoal canister 3 and the fuel tank 1.

In a step S3040 it is judged according to the signal from the pressure sensor 6 whether the pressure in the evaporative emission control system is converged to the converged limit negative pressure valve or not. When the pressure in the evaporative emission control system has not converged, the program returns to the step S3030. When the pressure has converged, the program proceeds to a step S3050.

In a step S3050 the engine control unit 50 reads in the converged limit negative pressure value.

In a step S3060 it is judged whether the limit negative pressure value is smaller (nearer to the atmospheric pressure) than the lead decision value or not. When the judgment in the step S3060 is "YES", the program proceeds to a step S3070 wherein it is judged that the leak amount of the evaporative fuel is larger than the allowable value, that is, it is judged that the evaporative emission control system is in a leak condition. When the judgment in the step S3060 is "NO", the program proceeds to a step S3080 wherein it is judged that the leak amount of the evaporative fuel is smaller than or equal to an allowable value, that is, it is judged that the evaporative emission control system is in a no-leak condition. In the program, the steps S3060, S3070 and S3080 constitute an evaporative fuel leak diagnosis means.

Following the operation of the step S3070 or S3080, the program proceeds to a step S3090 wherein the drain-cut valve 5 is opened. Then, the program proceeds to "END".

With the thus arranged leak diagnosis system, the inner space volume in the evaporative emission control system is detected by detecting the fuel remaining amount in the fuel tank 1. Taking the inner space volume into the consideration, the decision value is properly selected from the map in the engine control unit 50. Accordingly, the leak diagnosis of the evaporative fuel in the evaporative emission control system is finely implemented without being affected by the change of the inner space volume in the evaporative emission control system.

Although in the second embodiment the pressure sensor 6 has been used in order to detect the pressure in the evaporative emission control system, it will be understood that a pressure switch may be used instead of the pressure sensor 6 in the second embodiment.

Referring to FIGS. 10 to 17, there is shown a third embodiment of the leak diagnosis system according to the present invention.

The construction of the third embodiment is generally similar to that of the second embodiment except that a fuel temperature sensor 21 is further installed in the fuel tank 1. The fuel temperature sensor 21 detects a temperature of liquid fuel in the fuel tank 1 and outputs a signal indicative of the fuel temperature to the engine control unit 50. The engine control unit 50 obtains a generating amount of the fuel vapor (or fuel vapor pressure) on the basis of the signal from the fuel temperature sensor 21. That is, the engine control unit 50 stores a map of FIG. 13 which shows a relationship between the generating amount of fuel vapor and the fuel temperature. The engine control unit 50 determines a generating amount of fuel vapor on the basis of the map of FIG. 13 and the signal from the fuel temperature sensor 21. In this embodiment, the fuel temperature sensor 21 and the engine control unit 50 function as a means for detecting the generating amount of fuel vapor.

Figure 12:
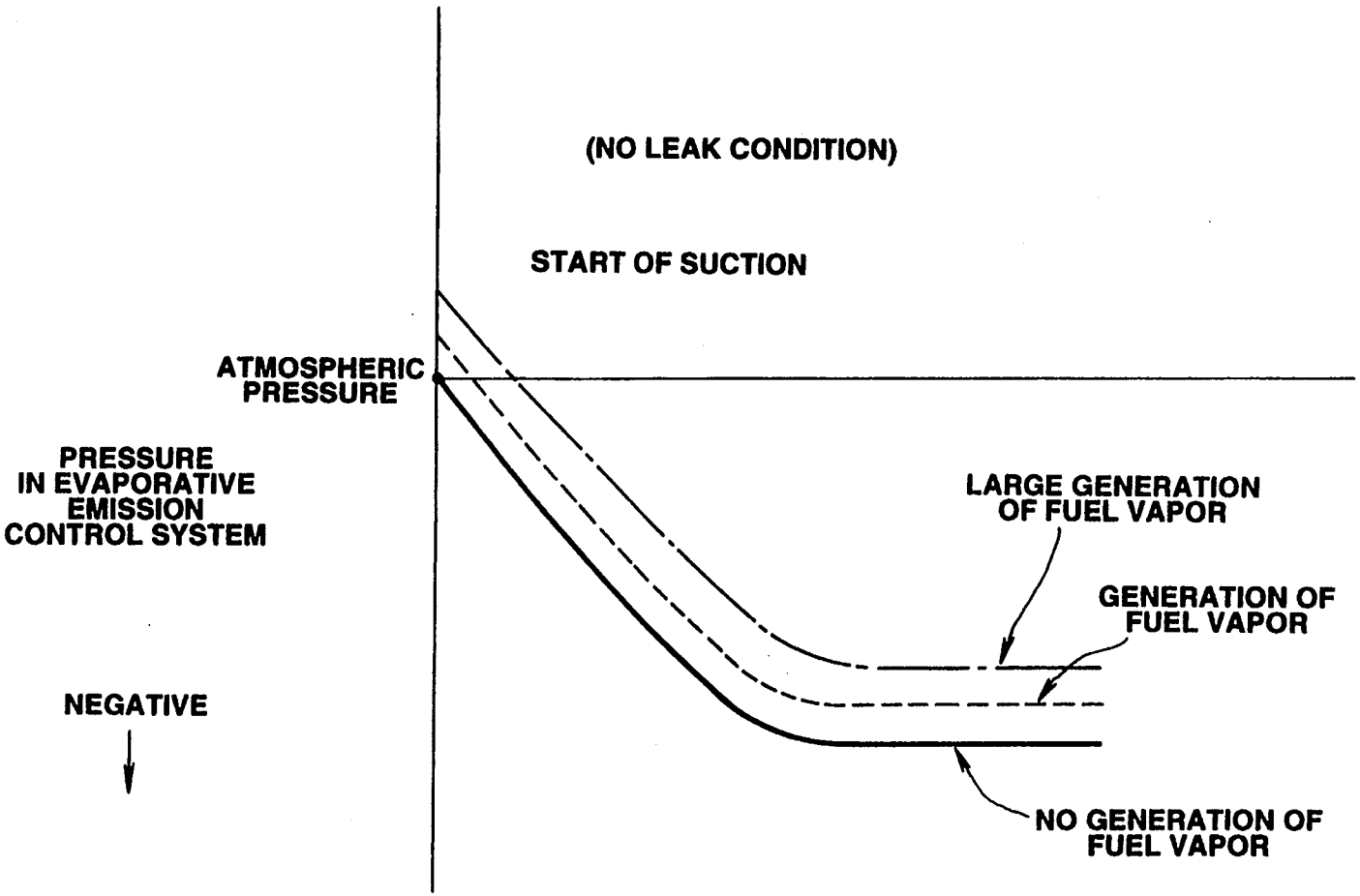
FIG. 12 is a graph which shows a change of the inner pressure due to the change of the generating amount of fuel vapor.
Figure 13:
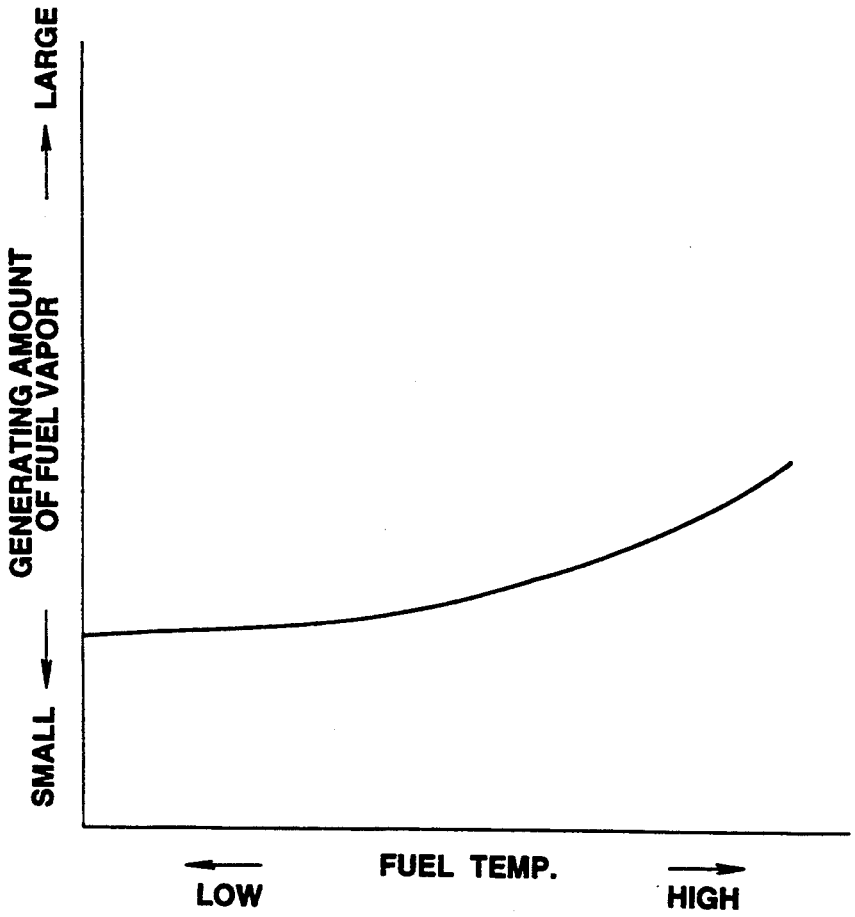
FIG. 13 is a graph which shows a relationship between a fuel temperature and the generating amount of fuel vapor.
Figure 14:
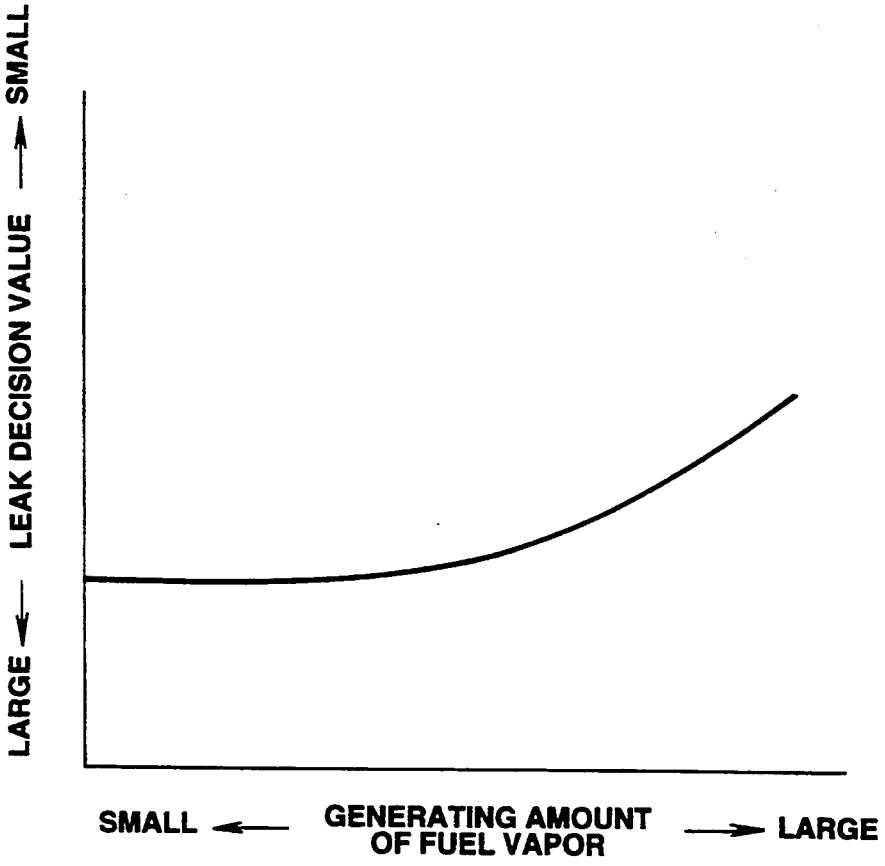
FIG. 14 is a map used in the third embodiment for a correction of a leak decision value relative to the change of the generating amount of fuel vapor.
Figure 15:
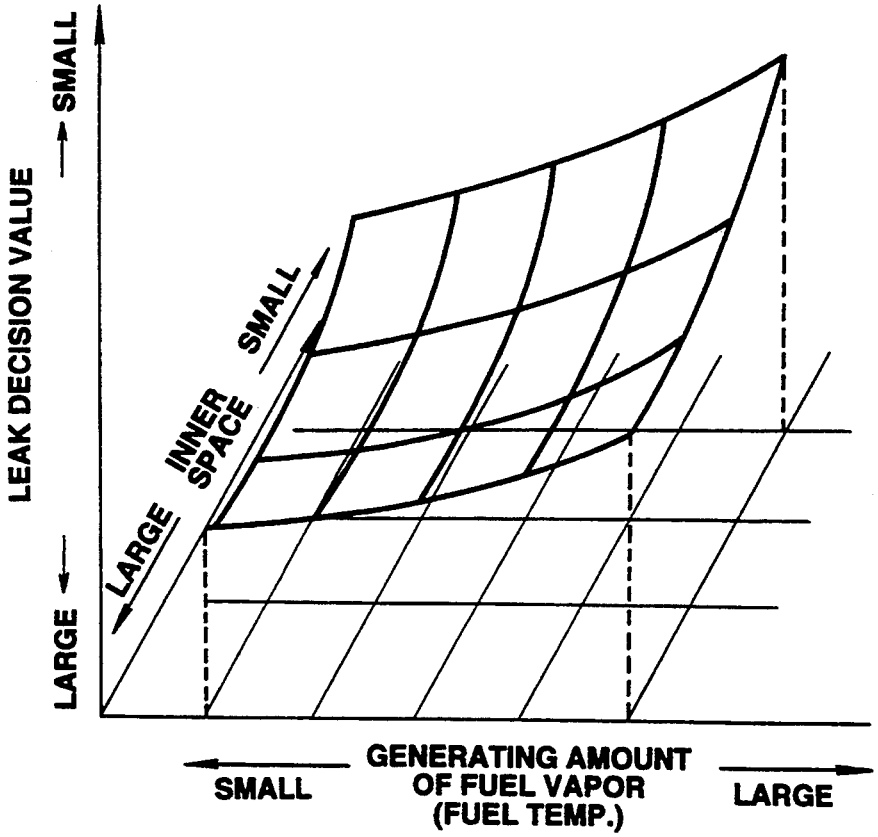
FIG. 15 is a map used in the third embodiment for a correction of a leak decision value taking the change of the generating amount of fuel vapor and the inner space in the system into consideration.

The engine control unit 50 stores a map of FIG. 15 in its memory in the form of digital data. The map of FIG. 15 is used for selecting a leak decision value according the inner space volume and the fuel temperature. The map of FIG. 15 is obtained on the basis of the relationship between the generating amount of the fuel vapor and the leak decision value as shown in FIG. 14 and the relationship between the inner space volume and the leak decision value as shown in FIG. 9. The relationship shown in FIG. 14 is obtained from the relationship shown in FIG. 13 which is obtained from the relationship shown in FIG. 12. As shown in FIG. 12, even if the evaporative emission control system is in a no-leak condition, the converged limit negative pressure becomes different due to the difference of the generating amount of the fuel vapor. Furthermore, as discussed in the explanation of the second embodiment, the converged limit negative pressure becomes different due the difference of the inner space volume. Accordingly, the leak decision value is varied (or corrected) according to the fuel temperature and the inner space volume. That is, the map of FIG. 15 functions as a means for correcting a leak decision value in this embodiment.

Figure 11:
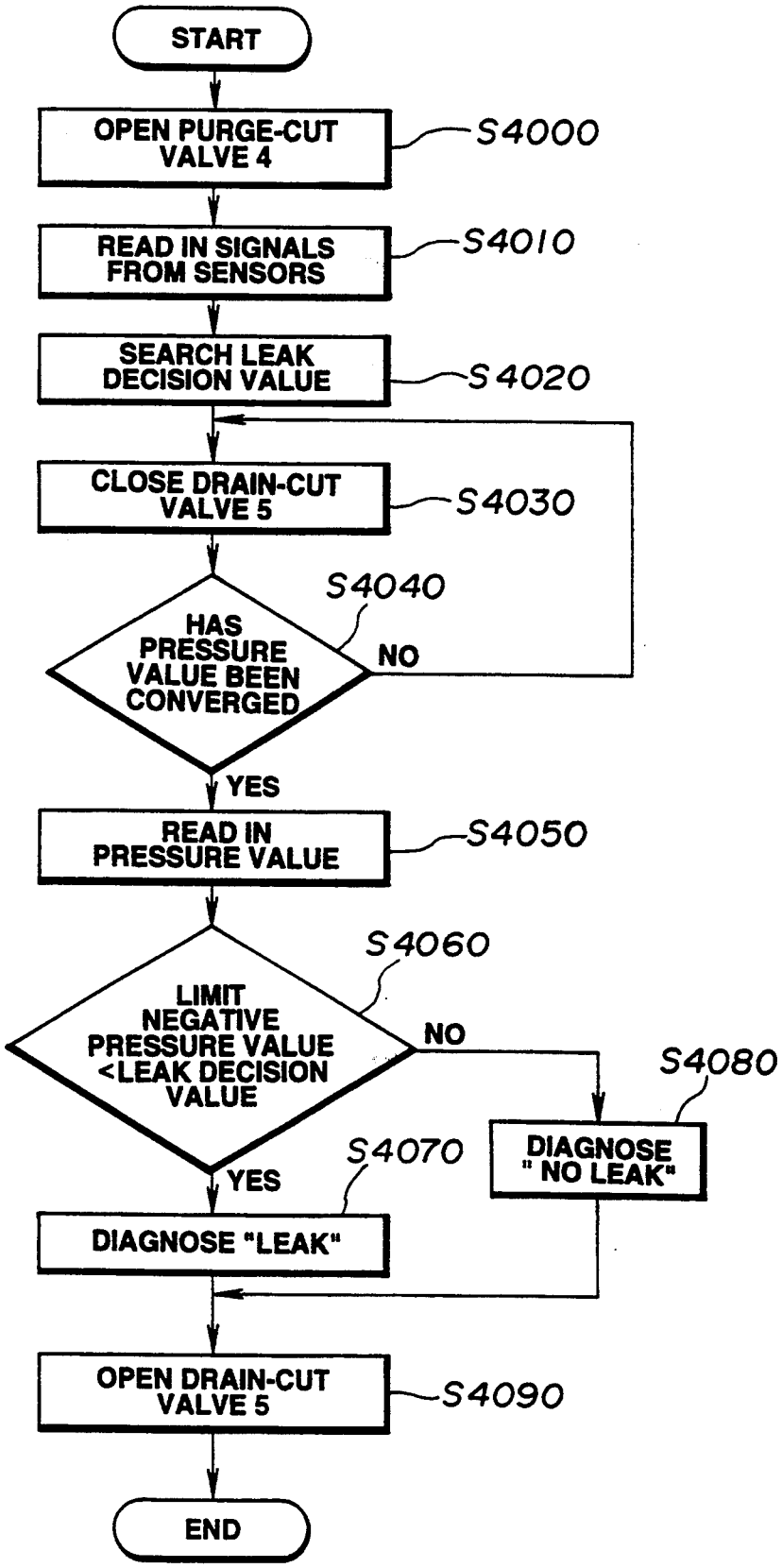
FIG. 11 is a flow chart a control of the third embodiment.

The manner of operation by the engine control unit 50 of the third embodiment will be discussed hereinafter with reference to a flow chart shown in FIG. 11.

In a step S4000 the purge-cut valve 4 is opened during a predetermined engine operating condition, so that the evaporative fuel adsorbed in the charcoal canister 3 is purged into the engine due to intake negative pressure generated in the engine.

In a step S4010 the engine control unit 50 reads in the signals from the fuel remaining amount detector 20 and the fuel temperature sensor 21 in order to detect the fuel remaining amount in the fuel tank 1 and the fuel temperature.

In a step S4020 a proper leak decision value is picked up from the map of FIG. 15 according to the fuel remaining amount and the fuel temperature.

In a step S4030 the drain-cut valve 5 is closed such that the negative pressure of the engine is applied to an evaporative emission control system constituted by the evaporative fuel conduits 2a and 2b, the charcoal canister 3 and the fuel tank 1.

In a step S4040 it is judged according to the signal from the pressure sensor 6 whether the pressure in the evaporative emission control system is converged to a converged limit negative pressure valve or not. When the pressure in the evaporative emission control system has not converged, the program returns to the step S4030. When the pressure has converged, the program proceeds to a step S4050.

In a step S4050 the engine control unit 50 reads in the converged limit negative pressure value.

In a step S4060 it is judged whether the limit negative pressure value is smaller (nearer to the atmospheric pressure) than the lead decision value or not. When the judgment in the step S4060 is "YES", the program proceeds to a step S4070 wherein it is judged that the leak amount of the evaporative fuel is larger than the allowable value, that is, it is judged that the evaporative emission control system is in a leak condition. When the judgment in the step S3060 is "YES". the program proceeds to a step S4080 wherein it is judged that the leak amount of the evaporative is smaller than or equal to an allowable value, that is, it is judged that the evaporative emission control system is in a no-leak condition. In the program, the steps S4060, S4070 and S4080 function as an evaporative fuel leak diagnosis means.

Following the operation of the step S4070 or S4080, the program proceeds to a step S4090 wherein the drain-cut valve 5 is opened. Then, the program proceeds to "END".

With the thus arranged leak diagnosis system, the inner space volume in the evaporative emission control system is obtained by detecting the fuel remaining amount in the fuel tank 1, and the generating amount of fuel vapor in the evaporative emission control system is obtained by detecting the fuel temperature of the fuel in the fuel tank 1. Furthermore, taking the inner space volume and the generating amount of fuel vapor into the consideration, the decision value is properly selected from the map of FIG. 15 in the engine control unit 50. Accordingly, the leak diagnosis of the evaporative fuel in the evaporative emission control system is finely implemented without being affected by the changes of the inner space volume and the generating amount of fuel vapor in the evaporative emission control system.

Although in the third embodiment the leak decision value has been obtained according to the signal from the fuel remaining amount detector 20 and the fuel temperature sensor 21, it will be understood that the decision value may be obtained by the map shown in FIG. 14 and the signal only from the fuel temperature sensor 21.

Furthermore, it will be understood that a pressure switch, which outputs an ON signal when the pressure in the evaporative emission control system is larger (further from the atmospheric pressure) than a desired pressure, may be used instead of the pressure sensor 6.

Figure 16:
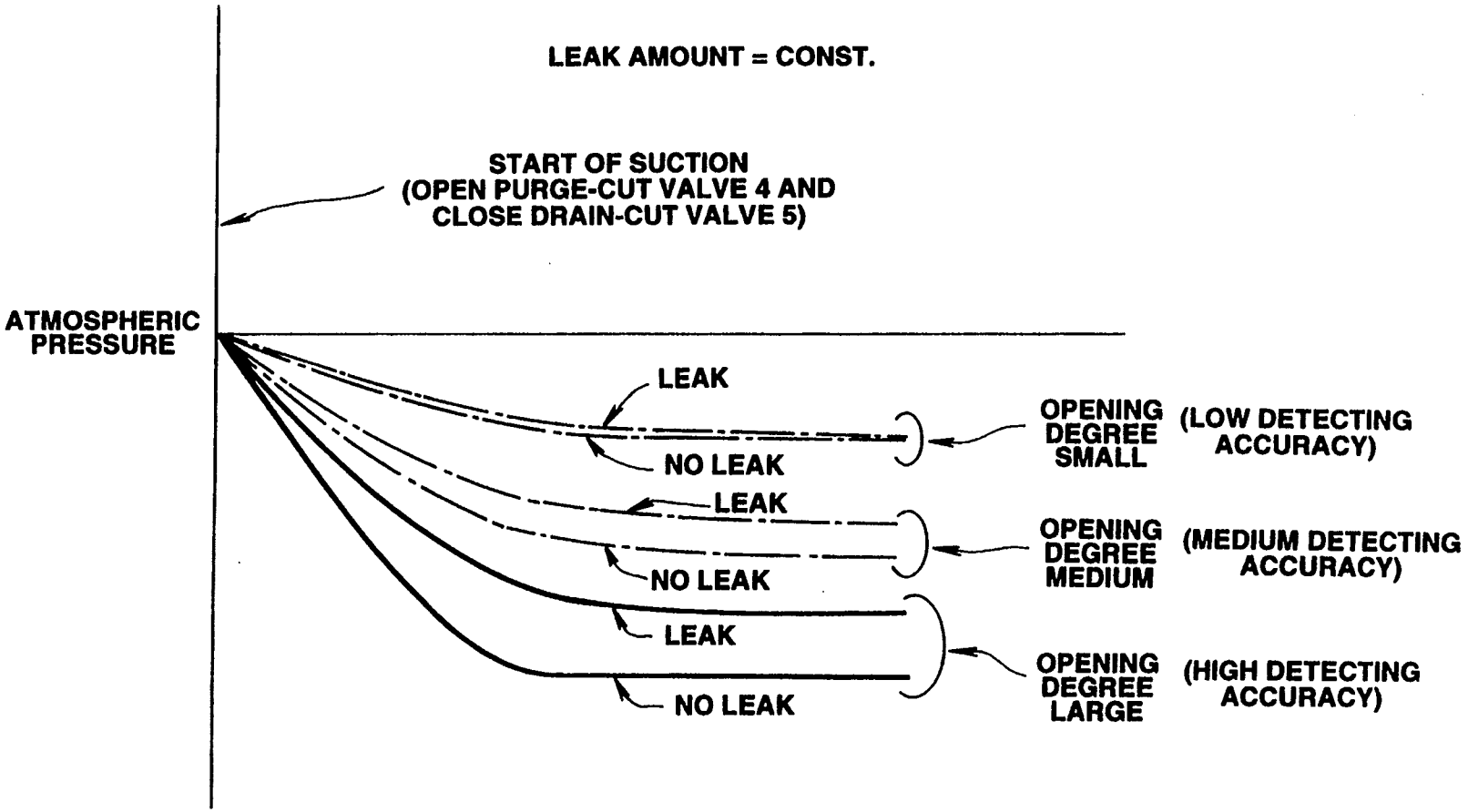
FIG. 16 is a graph which shows the change of pressure in the evaporative emission control system relative to the change of an opening degree of an opening degree control valve.
Figure 17:
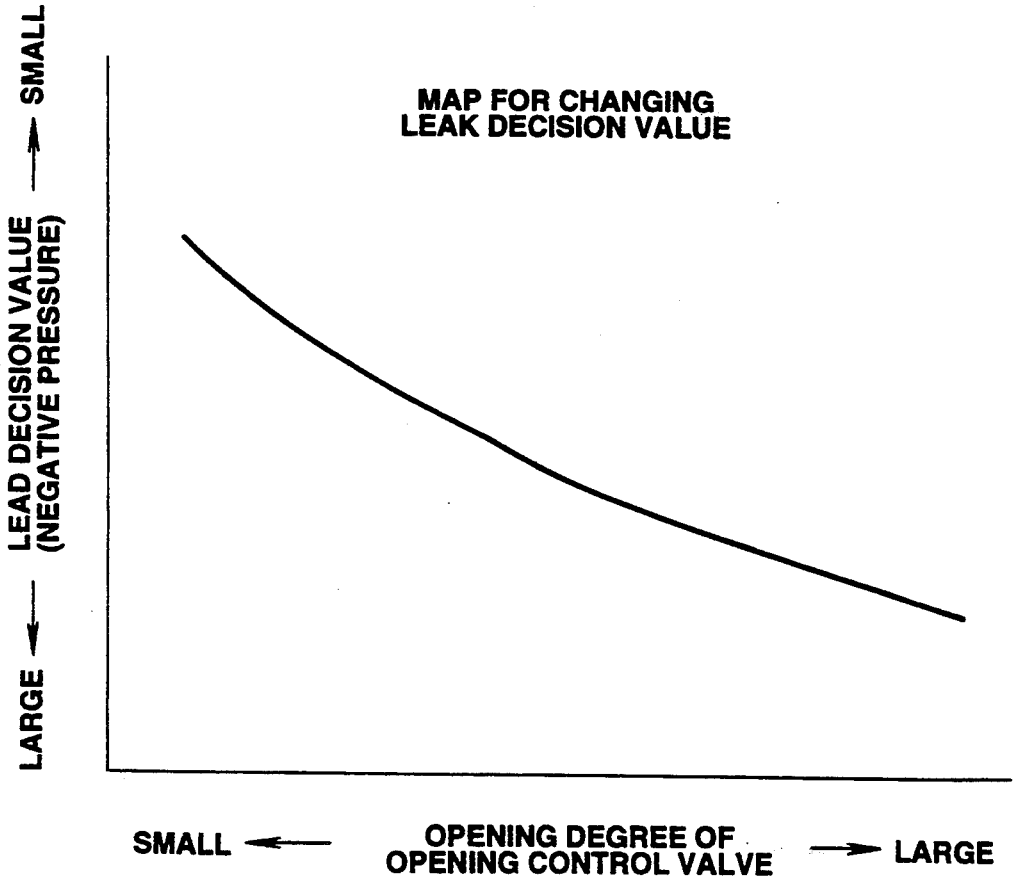
FIG. 17 is a map used in the third embodiment for a changing of the leak decision value according to the change of the opening degree of the opening degree control valve.
Figure 18:
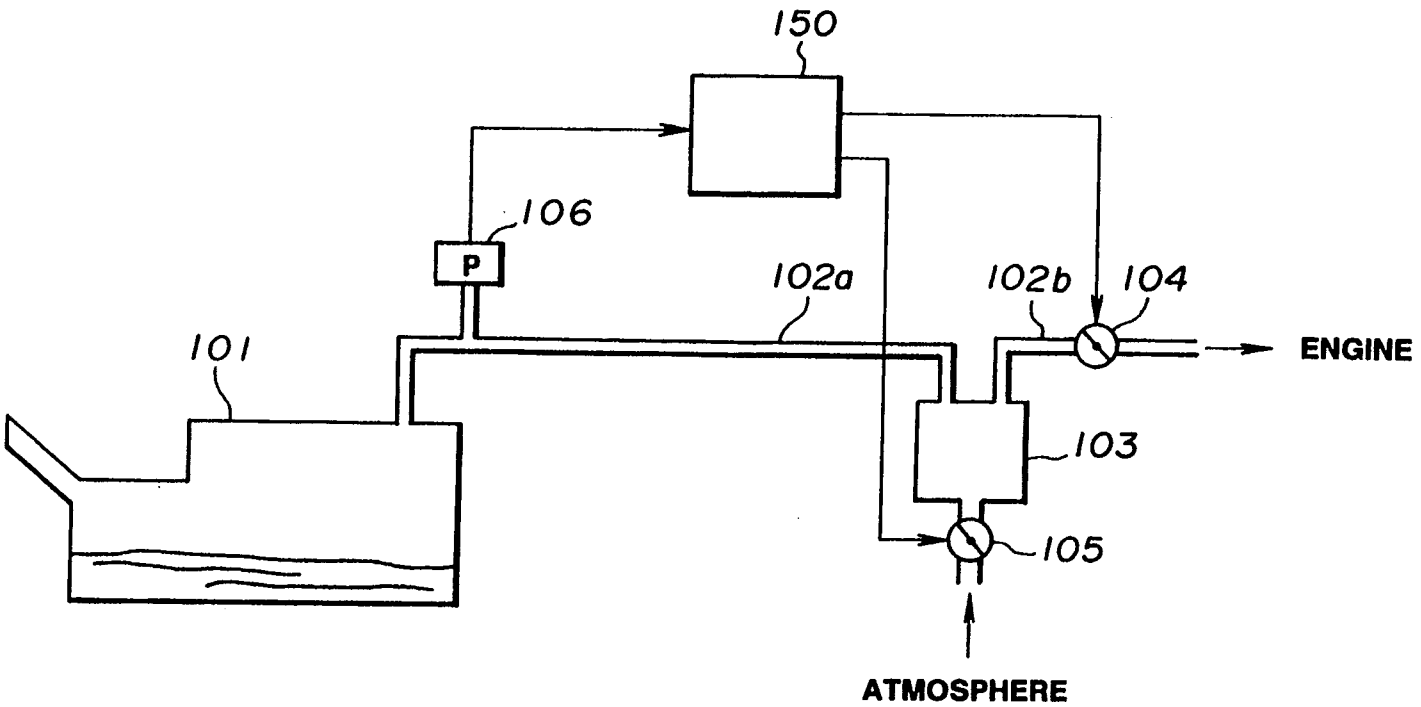
FIG.18 (PRIOR ART)
FIG. 18 is a block diagram of a conventional leak diagnosis system.
Figure 19:
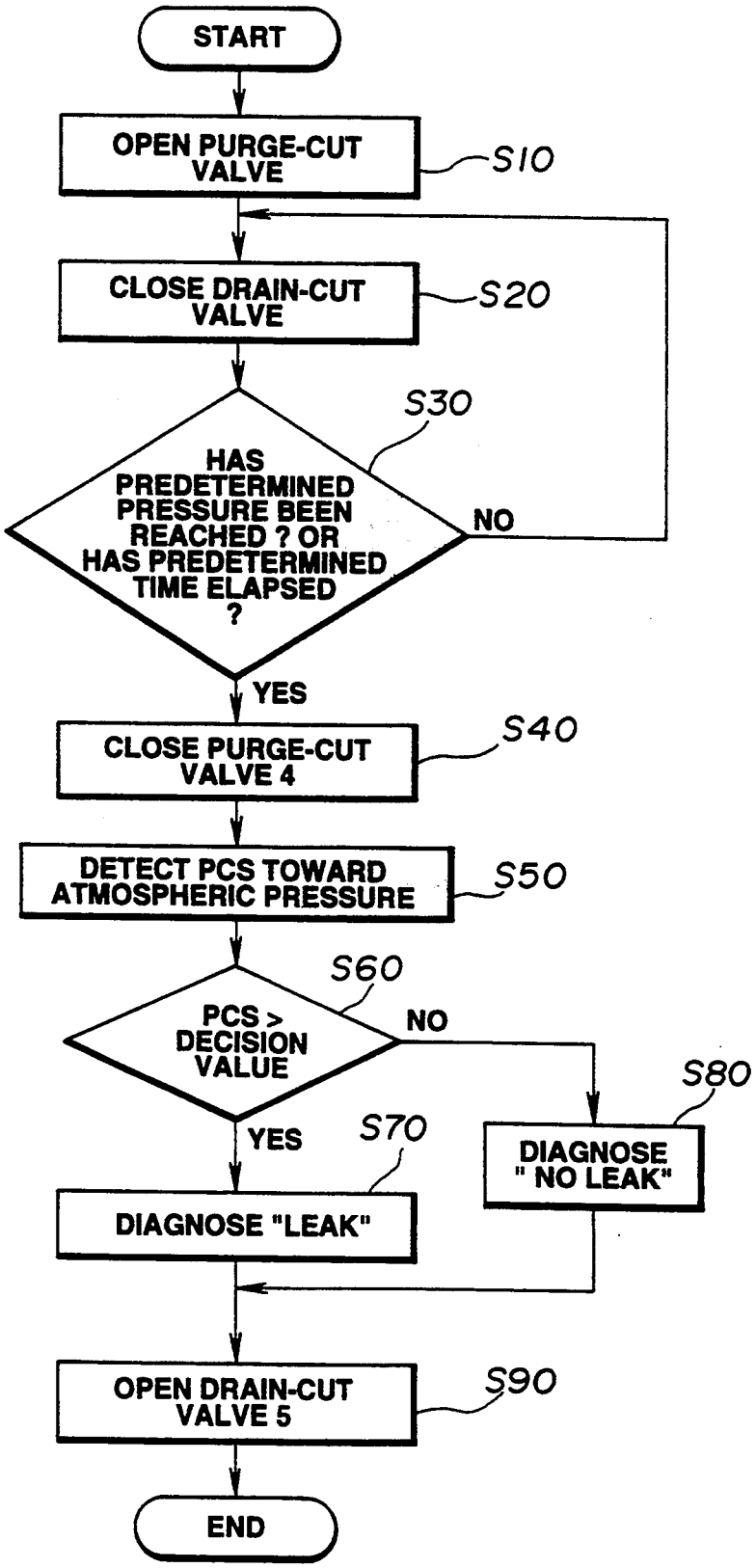
FIG.19 (PRIOR ART)
FIG. 19 is a flow chart used in the conventional leak diagnosis system of FIG. 18.
Figure 20:
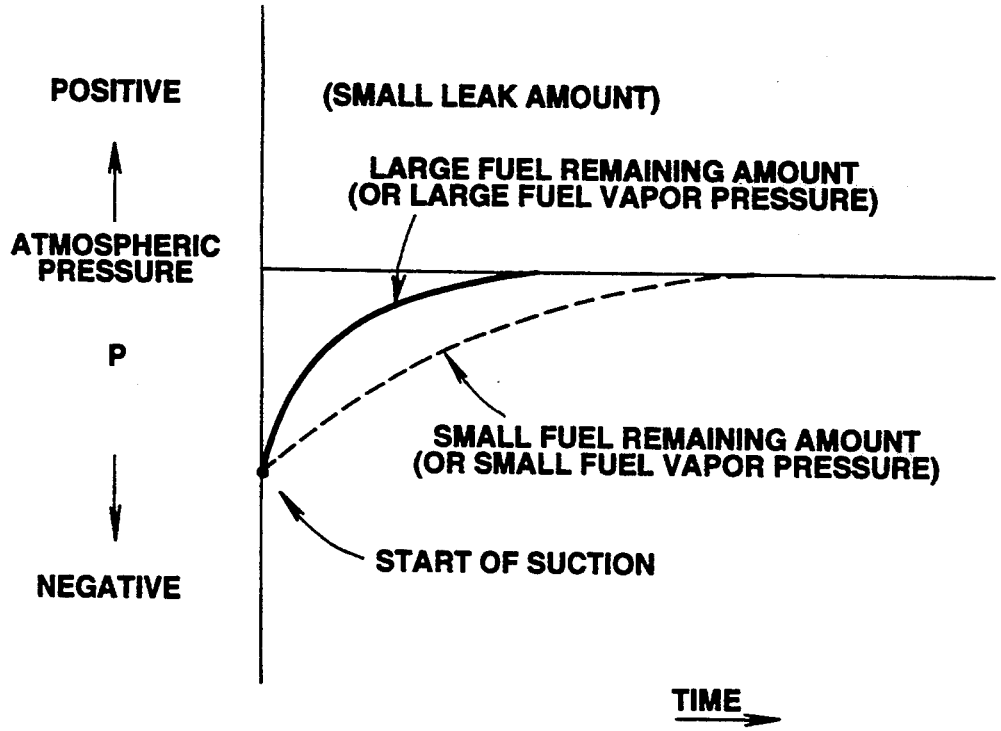
FIG.20 (PRIOR ART)
FIG. 20 is a graph which shows a change of pressure change due to the change of a fuel remaining amount or generating amount of fuel vapor in an evaporative emission control system.

In addition, it will be appreciated that an opening-degree control valve, which enables the opening degree to be variably controlled, may be used as a purge-cut valve. That is, by controlling the opening degree of the opening degree control valve, the converged limit negative pressure of the evaporative emission control system is adjusted at a desired value as shown in FIG. 16. Therefore, it becomes possible to vary a leak detecting accuracy of the leak diagnosis system by controlling the opening degree of the opening-degree control valve. In the case that the opening-degree control valve is applied to the leak diagnosis system, a leak diagnosis is implemented by using a signal from the pressure sensor 6 and a map of FIG. 17 in which the decision value gradually changes large when the opening degree of the opening-degree control valve gradually changes large.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. A leak diagnosis system for an evaporative emission control system of an internal combustion engine, said leak diagnosis system comprising:

a pressure detecting means for detecting a pressure in the evaporative emission control system and for outputting a signal indicative of the pressure of the evaporative emission control system; and a leak diagnosis means for obtaining a converged limit negative pressure in the evaporative emission control system which is under a suction condition by the engine according to the signal from said pressure detecting means, said leak diagnosis means diagnosing a leak condition of the evaporative emission control system by comparing the converged limit negative pressure with a predetermined leak decision value.

2. A leak diagnosis system as claimed in claim 1, further comprising:

an inner space volume detecting means which detects an inner space volume of the evaporative emission control system, and a leak decision value correcting means which corrects the predetermined leak decision value according to the detected inner space volume.

3. A leak diagnosis system as claimed in claim 1, further comprising:

a fuel-vapor generating-amount detecting means which detects a generating amount of fuel vapor in the evaporative emission control system, and a second leak decision value correcting means which corrects the predetermined leak decision value according to the detected generating amount of fuel vapor.

4. A leak diagnosis system as claimed in claim 2, further comprising:

a fuel-vapor generating-amount detecting means which detects a generating amount of fuel vapor in the closed evaporative emission control system and a second leak decision value correcting means which corrects the predetermined leak decision value according to the detected generating amount of fuel vapor.

5. A leak diagnosis means for an evaporative emission control system of an internal combustion engine, said leak diagnosis system comprising:

a pressure detecting means for detecting a pressure in the evaporative emission control system; and a leak diagnosis means for obtaining a converged limit negative pressure in the evaporative emission control system which is under a suction condition by the engine, said leak diagnosis means diagnosing a leak condition of the evaporative emission control system by comparing the converged limit negative pressure with a predetermined leak decision value, wherein the evaporative emission control system includes an opening-degree control valve which functions as a shut-off means between the evaporative emission control system and the engine, the opening-degree control valve functioning as a leak decision value changing means which changes the leak decision value according to the opening degree of the opening-degree control valve.

6. A leak diagnosis system for an evaporative emission control system applied to an internal combustion engine for an automotive vehicle, the evaporative emission control system having an evaporative fuel adsorbing means which temporally adsorbs evaporative fuel from a fuel tank and from which the adsorbed evaporative fuel is purged in the internal combustion engine under a predetermined engine operating condition, said leak diagnosis system comprising:

a fuel remaining amount sensor installed in the fuel tank, said fuel remaining amount sensor detecting a fuel remaining amount in the fuel tank and outputting a signal indicative of the fuel remaining amount in the fuel tank;

a fuel temperature sensor installed in the fuel tank, said fuel temperature sensor detecting a fuel temperature in the fuel tank and outputting a signal indicative of the fuel temperature in the fuel tank;

a pressure sensor for detecting a pressure in the evaporative emission control system when the evaporative emission control system is communicated with the operating engine and for outputting a signal indicative of a pressure in the evaporative emission control system; and a control unit obtaining a converged limit negative pressure in the evaporative emission control system according to the signal from said pressure sensor, said control unit having a map for selecting a leak decision value according to the remaining fuel amount and fuel temperature, said control unit selecting a leak decision value from the map according to the signals from said fuel remaining amount sensor and said fuel temperature sensor, said control unit diagnosing a leak condition of the evaporative emission control system by comparing the converged limit negative pressure with the selected leak decision value.

7. A leak diagnosis system as claimed in claim 6, further comprising:

a drain-cut valve which cuts the communication between a charcoal canister of the evaporative emission control system and the atmosphere.

8. A leak diagnosis system for an evaporative emission control system applied to an internal combustion engine for an automotive vehicle, the evaporative emission control system having an evaporative fuel adsorbing means which temporally adsorbs evaporative fuel from a fuel tank and from which the adsorbed evaporative fuel is purged in the internal combustion engine under a predetermined engine operating condition, said leak diagnosis system comprising:

first means for detecting a volume of a fuel vapor existing in a fuel vapor existing space in the evaporative emission control system;

second means for detecting a generating amount of fuel vapor in the evaporative emission control system;

third means for detecting a pressure value in the evaporative emission control system when the evaporative emission control system is communicated with the operating engine and for outputting a signal indicative of a pressure in the evaporative emission control system;

fourth means for selecting a leak decision value according to the fuel vapor existing space and the generating amount of fuel vapor;

fifth means for obtaining a converged limit negative pressure in the evaporative emission control system from the signal of said third means;

sixth means for comparing the converged limit negative pressure value of said third means with the leak decision value of said fourth means; and seventh means or outputting an alarm to a vehicle passenger when the converged limit negative pressure is nearer to the atmospheric pressure than the selected leak decision value.

* * * * *